US008968552B2

(12) United States Patent
Ramaseshan et al.

(10) Patent No.: US 8,968,552 B2
(45) Date of Patent: Mar. 3, 2015

(54) HYDROTREATING AND AROMATIC SATURATION PROCESS WITH INTEGRAL INTERMEDIATE HYDROGEN SEPARATION AND PURIFICATION

(71) Applicant: Saudi Arabian Oil Company, Dhahran (SA)

(72) Inventors: Vinod Ramaseshan, Ras Tanura (SA); Ali Hasan Al-Abdulal, Dhahran (SA); Yuv Raj Mehra, Montgomery, TX (US)

(73) Assignee: Saudi Arabian Oil Company, Dhahran (SA)

( * ) Notice: Subject to any disclaimer, the term of this patent is extended or adjusted under 35 U.S.C. 154(b) by 90 days.

(21) Appl. No.: 13/667,746

(22) Filed: Nov. 2, 2012

(65) Prior Publication Data

US 2013/0112596 A1 May 9, 2013

Related U.S. Application Data

(60) Provisional application No. 61/555,905, filed on Nov. 4, 2011.

(51) Int. Cl.
*C10G 65/02* (2006.01)
*C10G 45/02* (2006.01)
(Continued)

(52) U.S. Cl.
CPC ..... *C10G 65/02* (2013.01); *C10G 45/44* (2013.01); *C10G 49/007* (2013.01); *C10G 65/08* (2013.01); *C10G 2300/202* (2013.01);
(Continued)

(58) Field of Classification Search
CPC ..... C10G 2300/202; C10G 2300/301; C10G 2300/4006; C10G 2300/4012; C10G 2300/42; C10G 45/44; C10G 49/007; C10G 65/02; C10G 65/08
USPC ..... 208/49, 89, 99, 144, 209, 210, 208, 208/212, 213
See application file for complete search history.

(56) References Cited

U.S. PATENT DOCUMENTS 5,110,444 A 5/1992 Haun et al.
5,114,562 A 5/1992 Haun et al.
(Continued)

FOREIGN PATENT DOCUMENTS

EP 1063275 A1 12/2000

OTHER PUBLICATIONS

PCT/US2012/063282, International Search Report and Written Opinion dated Dec. 17, 2012, 12 pages.

*Primary Examiner* — Walter D Griffin
*Assistant Examiner* — Derek Mueller
(74) *Attorney, Agent, or Firm* — Abelman, Frayne & Schwab

(57) ABSTRACT

An intermediate hydrogen separation and purification system is integrated with a hydrotreating and an aromatic saturation process for the production of relatively lower molecular weight products from a relatively heavy feedstock including sulfur-containing and aromatic-containing hydrocarbon compounds. The integrated process allows the processing of heavy hydrocarbon feedstock having high aromatic and high sulfur contents in a single-stage configuration and the using of noble metal catalyst in the aromatic saturation zone. The integrated process increases the overall catalytic activity and hydrogenation capability to produce superior distillate products.

3 Claims, 2 Drawing Sheets

(51) Int. Cl.
*C10G 45/44* (2006.01)
*C10G 49/00* (2006.01)
*C10G 65/08* (2006.01)

(52) U.S. Cl.
CPC . *C10G 2300/301* (2013.01); *C10G 2300/4006* (2013.01); *C10G 2300/4012* (2013.01); *C10G 2300/42* (2013.01)
USPC ..... 208/49; 208/89; 208/144; 208/209; 208/210; 208/212

(56) References Cited

U.S. PATENT DOCUMENTS 6,017,443 A 1/2000 Buchanan
6,241,952 B1 6/2001 Ellis et al.
6,447,673 B1 9/2002 Cordera et al.
6,569,314 B1 5/2003 Iaccino et al.
6,623,628 B1 9/2003 Bronner et al.
6,740,226 B2 * 5/2004 Mehra et al. ..... 208/101
7,166,209 B2 1/2007 Dassori
7,238,274 B2 7/2007 Turner
7,238,275 B2 7/2007 Stupin et al.
2002/0130063 A1 9/2002 Vuillemot et al.
2004/0238409 A1 12/2004 Virdi et al.
2005/0035026 A1 2/2005 Espinoza et al.
2005/0167334 A1 8/2005 Galeazzi
2008/0277317 A1 11/2008 Touffait et al.
2010/0108571 A1 5/2010 Schorfheide et al.

* cited by examiner

HYDROTREATING AND AROMATIC SATURATION PROCESS WITH INTEGRAL INTERMEDIATE HYDROGEN SEPARATION AND PURIFICATION

RELATED APPLICATIONS

This application claims the benefit of U.S. Provisional Patent Application No. 61/555,905 filed Nov. 4, 2011, the disclosure of which is hereby incorporated by reference.

BACKGROUND OF THE INVENTION

1. Field of the Invention

The present invention relates to hydrotreating and aromatic saturation systems and method for efficient production of high quality distillates from high sulfur, high aromatic hydrocarbons at existing or new hydrocracking facilities.

2. Description of Related Art

Hydrotreating technology is a well-known prior art where hydrocarbon feed boiling in the range of from 150° C.-400° C. (302° F.-752° F.) is mixed with hydrogen at a temperature in the range of from 200° C.-500° C. (392° F.-932° F.) and a pressure in the range of from 34 barg-100 barg (493 psig-1450 psig) and the mixture is passed over heterogeneous fixed bed catalyst. The contaminants in the hydrocarbon feed, such as the sulfur, nitrogen, and oxygen compounds, are almost completely removed, and any olefins present are saturated, thereby producing products that are a mixture of essentially pure paraffins and naphthenes. Some of the aromatic content is also saturated. Acceptable product will meet the ultra low sulfur distillates specifications. The heterogeneous fixed bed catalyst contains at least one Group VIII metal, and at least one Group VIB metal. Generally, these metals are included on a support material such as alumina with or without silica or some other promoter.

The desired degree of hydrotreating takes place as the feed is processed over fixed beds of catalyst at elevated hydrogen pressure and temperature. The amount of catalyst required per volume of feed and the pressure level are set by the quality of the feed and desired products.

When there is a requirement of maximum aromatic saturation, the product from the distillate hydrotreating section is then further processed in an aromatic saturation reaction zone. The aromatic saturation of distillates is also a well known prior art, where the hydrocarbon feed is again mixed with hydrogen at temperatures in the range of from 200° C.-400° C. (392° F.-752° F.) and a pressure in the range of from 34 barg-100 barg (493 psig-1450 psig) and the mixture is passed over heterogeneous fixed bed catalyst. The heterogeneous fixed bed catalyst contains at least one Group VIII noble metal. Generally, these metals are included on a support material such as alumina with or without a cracking acidic component such as an amorphous silica alumina or a zeolite. The hydrocarbon feed is converted to higher-value low sulfur, low aromatic products, which are used as transportation fuel and meet the current Ultra Low sulfur distillate specifications.

The desired degree of aromatic saturation takes place as the essentially sulfur-free feed is processed over fixed beds of catalyst at elevated hydrogen pressure and temperature. The amount of catalyst required per volume of feed and the pressure level are set by the quality of the feed and the desired products.

Traditionally hydrotreating followed by aromatic saturation is carried out in multiple stages when the processes are combined into a single unit or carried out with two separate units. As the sulfur and aromatic content for a given distillation range in a hydrocarbon feed increases, the quantity of ammonia and hydrogen sulfide present in the hydrotreating zone effluent will also increase. The hydrogen sulfide will begin to inhibit aromatic saturation, and therefore in order to meet a high cetane number or smoke point for the particular distillate fraction, further processing is required. Catalytically this is achieved by increasing the hydrogenation function in the second stage-aromatic saturation zone. Since higher hydrogenation requires the use of noble metal catalyst which are poisoned by hydrogen sulfide, an intermediate fractionation section to strip out the hydrogen sulfide, ammonia and light ends is required. The stripped feed is then processed in the sweet (hydrogen sulfide free) second stage where aromatic saturation is carried out over a noble metal catalyst system followed by the fractionation section to strip out the hydrogen sulfide and light ends. This complicates the overall plant design and increases the amount of recycle gas required to achieve the desired targets.

Accordingly, a need exists in the art for improved hydrotreating and aromatic saturation processes operations, particularly for new systems capable of processing feedstocks with relatively high sulfur and aromatic content, or for existing systems which have been limited by catalyst activity and distillate selectivity.

SUMMARY OF THE INVENTION

The above objects and further advantages are provided by herein described process. An intermediate hydrogen separation and purification system is integrated with a hydrotreating and an aromatic saturation process for the production of relatively lower molecular weight products from a relatively heavy feedstock including sulfur-containing and aromatic-containing hydrocarbon compounds. The integrated process allows the processing of heavy hydrocarbon feedstock having high aromatic and high sulfur contents in a single-stage configuration and the using of noble metal catalyst in the aromatic saturation zone. The integrated process increases the overall catalytic activity and hydrogenation capability to produce superior distillate products.

The integrated hydroprocessing process is for the production of relatively lower molecular weight products from a relatively heavy feedstock including sulfur-containing and aromatic-containing hydrocarbon compounds. The process comprising comprises:

a. hydrotreating the feedstock with a hydrotreating catalyst in the presence of hydrogen to produce a hydrotreated effluent containing a reduced amount of sulfur-containing hydrocarbon compounds;
b. separating the hydrotreated effluent in a high-pressure separation zone to produce a vapor stream and a hydrocarbon liquid stream;
c. purifying at least a portion of the vapor stream in an absorption zone in the presence of at least a portion of relatively heavier components of vapor stream from step (b) to produce a high purity hydrogen gas stream and a fuel gas stream;
d. saturating the aromatic compounds contained in a portion of the hydrocarbon liquid stream with an aromatic saturation catalyst in the presence of hydrogen gas to produce an aromatic saturated effluent, wherein the hydrogen gas includes the high purity hydrogen gas stream from step (c) along with make-up hydrogen stream ; and
e. separating and fractioning the aromatic saturated effluent to produce one or more overhead gas streams, one or more sour water streams and overhead and bottom fractioned distillate products.

In certain embodiments, step (b) comprises separating the hydrotreated effluent in a hot high-pressure separation zone to produce a hydrotreated gas stream and a hydrotreated liquid stream, and separating the hydrotreated gas stream in a cold high-pressure separation zone to produce a vapor stream, a hydrocarbon liquid stream and a sour water stream, wherein the relatively heavier components of the vapor stream used in step (c) are derived from further condensation of the heavier fractions in the vapor stream generated from the cold separator and additional make up provided by the portion of the hydrocarbon liquid stream from the cold high-pressure separation zone.

BRIEF DESCRIPTION OF THE DRAWINGS

The following detailed description will be best understood when read in conjunction with the attached drawings. For the purpose of illustrating the invention, there are shown in the drawings embodiments which are presently preferred. It should be understood, however, that the invention is not limited to the precise arrangements and apparatus shown. In the drawings the same numeral is used to refer to the same or similar elements, in which.

DETAILED DESCRIPTION OF THE INVENTION

An integrated hydrotreating and aromatic saturation configuration is provided which incorporates a hydrogen separation zone along with hydrogen purification by absorption. These additional steps are located between the hydrotreating reaction zone and the aromatic saturation zone. This removes ammonia and hydrogen sulfide from the intermediate reaction effluent, and allows a purified hydrogen stream to be recombined with the liquid streams to be saturated in an essentially ammonia-free and hydrogen sulfide-free environment.

Figure 1:
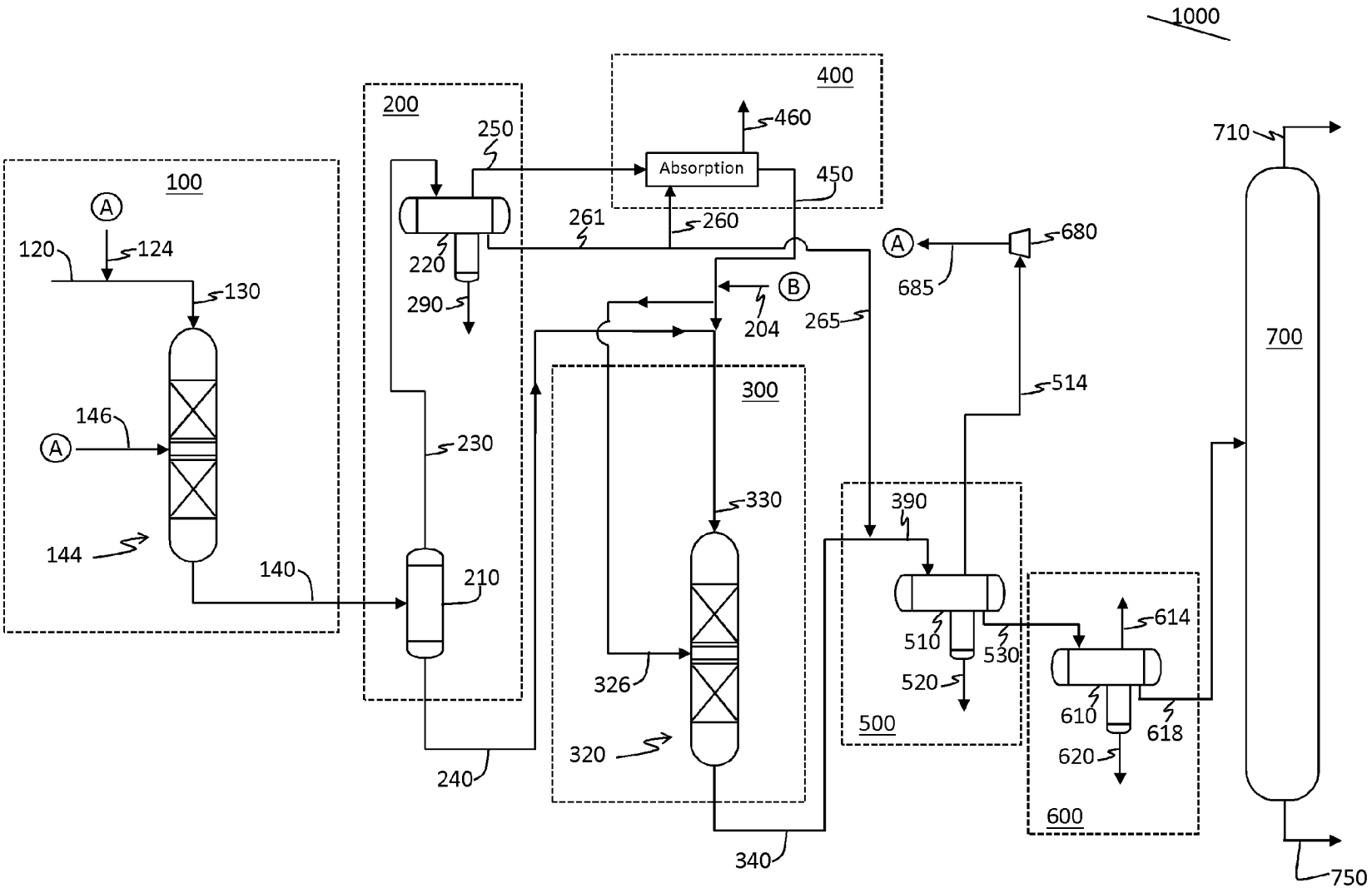
FIG. 1 is a process flow diagram of a hydrotreating and aromatic saturation system integrated with an intermediate hydrogen separation and purification system.

In particular, and referring now to FIG. 1, a process flow diagram of an integrated hydroprocessing apparatus 1000 is illustrated. Apparatus 1000 includes a hydrotreating zone 100, a first high-pressure separation zone 200, an aromatic saturation zone 300, an absorption zone 400, a second high pressure separation zone 500, a flash zone 600, and a fractionation zone 700.

Hydrotreating zone 100 includes a reactor 144 containing an effective quantity of a suitable hydrotreating catalyst. Reactor 144 includes an inlet for receiving a combined stream 130 including a feedstock stream 120 and a hydrogen stream 124 and an inlet for receiving a quenching hydrogen stream 146. A hydrotreated effluent stream 140 is discharged from an outlet of reactor 144. In certain embodiments a hydrogen gas inlet can be separate from the feed inlet (in addition to the inlet for introduction of quenching hydrogen).

The first high-pressure separation zone 200 generally includes a hot high-pressure separation vessel 210 and a cold high-pressure separation vessel 220. Hot high-pressure separation vessel 210 includes an inlet for receiving the hydrotreated effluent 140, an outlet for discharging a hydrotreated gas stream 230 and an outlet for discharging a hydrotreated liquid stream 240. Stream 230, which includes one or more gases selected from the group comprising hydrogen, methane, ethane, ammonia, hydrogen sulfide, $C_5$+ hydrocarbons, exits the first separation vessel 210.

Cold high-pressure separation vessel 220 includes an inlet in fluid communication with separation vessel 210 and for receiving the partially condensed hydrotreated gas stream 230, an outlet for discharging a vapor stream 250, an outlet for discharging sour water stream 290 and an outlet for discharging a hydrocarbon liquid stream 261. Heat exchangers required to cool the hot stream before entering subsequent cold high pressure separator are not shown and their requirements should be understood by a person having ordinary skill.

Figure 2:
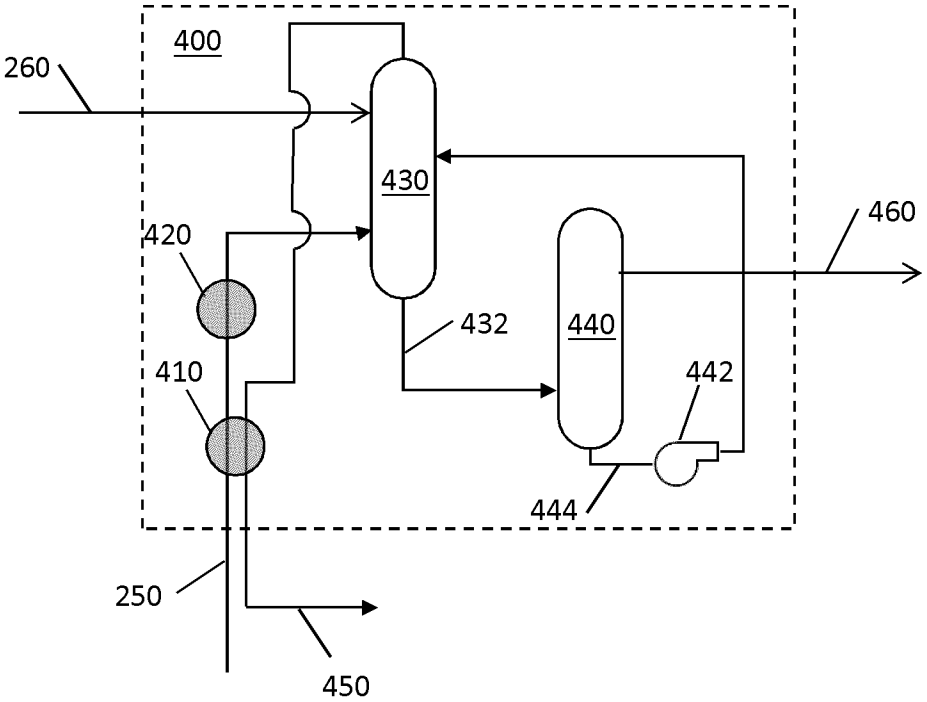
FIG. 2 is a schematic diagram of an absorption zone.

As shown in FIG. 2, absorption zone 400 includes a cross exchanger 410, a chiller 420, a methane absorber column 430, a flash regeneration vessel 440 and a solvent circulation pump 442. Methane absorber column 430 includes an inlet for receiving vapor stream 250 from high-pressure separation zone 200 after cross-exchanger 410 and chiller 420, an inlet for receiving recycle solvent stream 444 from flash regeneration vessel 440, an inlet for receiving solvent make-up stream 260, an outlet for discharging a rich solvent liquid stream 432 and an outlet for discharging a hydrogen stream 450. In absorption zone 400, stream 250 from the cold high pressure separator 220, which is a relatively low $H_2$ purity stream, is counter-currently contacted with a portion of condensed hydrocarbon liquids from stream 260 as solvent in the methane absorber column 430 to absorb methane and heavier hydrocarbons away from the contained hydrogen. Stream 250 is chilled in a heat exchanger 410 by cross-exchanging with a colder, purified, recycled hydrogen stream 450, followed by refrigeration unit 420 where it is cooled to about −20° F. In the absorber column 430, most heavy gases including methane, ethane, propane, butanes, pentanes and heavier gases, are absorbed and separated from the contained hydrogen in stream 250. The rich solvent liquid stream 432 from the bottom of the absorption zone 430 is passed to at least one flashing stage 440. Through pressure letdown in flash drums, rich solvent stream 432 is separated and a lean liquid solvent stream 444 is derived that can be recycled back to the methane absorber column 430 using a solvent circulation pump 442. The bulk of the solvent used for absorption is primarily the heavier hydrocarbons which are condensed from stream 250 after chilling The hydrocarbon stream 260 is primarily used as a make-up solvent.

Arrangements similar to absorption zone 400 are shown in U.S. Pat. Nos. 6,740,226, 4,740,222, 4,832,718, 5,462,583, 5,546,764 and 5,551,972, and U.S. Pub. No. 2007/0017851, the disclosures of which are all incorporated by reference herein in their entireties.

As depicted process flow lines in the figures can be referred to as streams, feeds, products or effluents. Depending upon the ammonia content, a water stream (not shown) can be added to stream 230 to remove ammonium bisulfide salts. Stream 290 is predominantly sour water that can be sent to any suitable destination such as a sour water stripper. The separated vapor from separator 220 leaves through stream 250 and enters the absorption zone 400. The portion 260 from the separator 220 liquid hydrocarbon discharge stream 261 is routed to form the absorption solvent through solvent make-up stream 260 for the absorption zone 400 as discussed above. A hydrocarbon stream 265, which is the remainder of stream 261 from the separator 220 that is not routed as absorption solvent make-up 260, bypasses the aromatic saturation zone 300.

The absorption zone 400 purifies the hydrogen present in stream 250 by absorbing components heavier than hydrogen with circulating solvent comprising solvent make-up stream 260 to produce a high purity (95-99 mol %) hydrogen stream 450 and a fuel gas stream 460 comprising components heavier than hydrogen as present in stream 250.

The high purity hydrogen stream 450 along with high purity make-up hydrogen stream 204 from manifold "Header B" then combine with liquid stream 240 to form a combined feed 330 to enter the aromatic saturation zone 300.

The aromatic saturation zone 300 includes an aromatic saturation reactor 320, which may have single or multiple catalyst beds and receive quench hydrogen streams in between the beds as simply shown by stream 326. Although only one quench hydrogen stream is shown, it should be understood that multiple streams may be provided to the aromatic saturation reactor 320 depending upon the number of beds. The aromatic saturation zone 300 can operate at any suitable condition. The effluent stream 340 from the aromatic saturation zone 300 along with the excess hydrocarbon stream 265 from the separator 220 combine to form stream 390 which enters the second separation zone 500.

Separation zone 500 includes a separation vessel 510. Heat exchangers are required to cool the hot stream 340 before entering the high pressure separator vessel 510. The high pressure separator drum 510 can provide an overhead stream 514 comprising hydrogen and methane (predominantly rich in hydrogen), a hydrocarbon stream 530 which enters the flash zone 600 and a heavy liquid stream 520 which is predominantly sour water that can be sent to any suitable destination such as a sour water stripper. A water stream (not shown) can be added to the combined stream 390 to remove ammonium salts.

Flash zone 600 includes a cold low-pressure flash drum 610. Heat exchangers required to cool the hot streams are not shown and their requirement should be understood by those of ordinary skill in the art. Typically, the flash drum 610 separates gases from condensed liquids or from liquids through pressure let down.

The low pressure cold flash drum 610 provides an overhead stream 614 comprising hydrogen and methane (predominantly rich in hydrogen), a hydrocarbon side stream 618 and a bottom stream 620 which is predominantly sour water that can be sent to any suitable destination such as a sour water stripper. The hydrocarbon liquid side stream 618 is introduced to the fractionation zone 700.

Generally, the fractionation zone 700 produces a variety of products, and includes an overhead stream 710, and a bottom stream 750. Typically, stream 710 comprises unstabilized naphtha, and the bottom stream 750 is essentially a high quality distillate product that in certain embodiments meets requisite product quality standards such as a high cetane number, a high smoke point and low sulfur content.

The high-pressure separator drum 510 provides an overhead stream 514, which is rich in hydrogen and can be recycled back after compression through recycle hydrogen compressor 680 to produce stream 685, which is recycled back to the hydrogen manifold "Header A". The high purity make-up hydrogen stream 204 from manifold "Header B" can typically be from a hydrogen generation unit.

The feedstock for present processes and apparatus generally contains components boiling in the range of from 150° C.-400° C. (302° F.-752° F.). Usually, these feeds can include straight run gas oil; a crude distillation unit product, such as light vacuum gas oil; a vacuum distillation unit product; a thermally cracked gas oil; a visbreaking unit, thermal cracking or coking unit product; light or heavy cycle oil; a fluid catalytic cracking unit product, and light gasoil derived from tar sands.

In general, the hydrotreating reaction zone can include a hydrotreating reactor which can have single or multiple catalyst beds and can receive quench hydrogen stream between the beds. Although only one hydrogen quench inlet is shown, it should be understood that the hydrogen stream can be provided anywhere along the hydrotreating reactor and multiple hydrogen streams may be provided depending upon the number of beds. The hydrotreating reactor beds typically contain a catalyst having at least one Group VIII metal, and at least one Group VIB metal. The Group VIII metal is selected from a group consisting of iron, cobalt, and nickel. The Group VIB metal is selected from a group consisting of molybdenum and tungsten. The Group VIII metal can be present in the amount of about 2-20% by weight, and the Group VIB metal can be present in the amount of about 1-25% by weight. Generally, these metals are included on a support material, such as silica or alumina. The operating conditions for hydrotreating reaction zone includes a reaction temperature in the range of from 200° C. to 500° C. (392° F. to 932° F.), and a reaction pressure in the range of from 34 barg to 100 barg (493 psig to 1450 psig).

The operating conditions for the hot high-pressure separation zone includes a temperature in the range of from 200° C. to 500° C. (392° F. to 932° F.), a pressure in the range of from 30 barg to 100 barg (435 psig to 1450 psig). The operating conditions for the cold high-pressure separation zone includes a temperature in the range of from 60° C. to 250° C. (140° F. to 482° F.), a pressure in the range of from 30 barg to 100 barg (435 psig to 1450 psig).

In general, the aromatic saturation zone can include an aromatic saturation reactor which can have single or multiple catalyst beds and can receive quench hydrogen stream between the beds. Although only one hydrogen quench inlet is shown, it should be understood that the hydrogen stream can be provided anywhere along the aromatic saturation reactor and multiple hydrogen streams may be provided depending upon the number of beds. The aromatic saturation reactor beds typically contain a catalyst having at least one Group VIII noble metal. The Group VIII noble metal is selected from a group comprising platinum, palladium, ruthenium, rhodium, osmium, and iridium. Generally, these metals are included on a support material, such as silica or alumina along with acidic component such as amorphous silica alumina or a zeolite. Usually, the Group VIII noble metal can be present in the amount of about 0.2-5% by weight. The operating conditions for aromatic saturation zone includes a reaction temperature in the range of from 200° C. to 400° C. (392° F. to 752° F.), and a reaction pressure in the range of from 30 barg to 100 barg (435 psig to 1450 psig).

The operating conditions for the separation zone 500 includes a temperature in the range of from 40° C. to 80° C. (104° F. to 176° F.), and a pressure in the range of from 30 barg to 100 barg (435 psig to 1450 psig).

The operating conditions for the cold low-pressure flash drum includes a temperature in the range of from 40° C. to 80° C. (104° F. to 176° F.), and a pressure in the range of from 20 barg to 50 barg (290 psig to 725 psig).

The operating conditions for the fractionation zone includes a temperature in the range of from 40° C. to 400° C. (104° F. to 752° F.), and a pressure in the range of from 0.05 bar to 20 bar (0.73 psig to 290 psig).

Heat transfer equipment, fluid transport equipment and mass transfer equipment have not always been shown and their requirement must be understodd by one skilled in the art.

Distinct advantages are offered by the integrated hydroprocessing apparatus and processes described herein when compared to conventional hydroprocessing configurations. The integrated process allows the processing of heavy hydrocarbon feed having high sulfur and high aromatic contents in a single-stage configuration which allows the reduction of recycle gas in the amount of 20% to 30% by volume compared to the normal gas flow needed for the conventional flow schemes utilizing two-stage designs. The integrated process also allows the ability to not only make ultra low sulfur distillates (ULSD) but also high smoke point kerosene and high cetane diesel when processing high sulfur and high aromatic distillate range feed stock. In addition, the integrated process allows a reduction in the system pressure because of higher hydrogen partial pressure at the hydroprocessing zones due to availability of high purity hydrogen and thus saving capital cost.

The method and system herein have been described above and in the attached drawings; however, modifications will be apparent to those of ordinary skill in the art and the scope of protection for the invention is to be defined by the claims that follow.

What is claimed is:

1. An integrated hydroprocessing process for the production of relatively lower molecular weight products from a relatively heavy feedstock including sulfur-containing and aromatic-containing hydrocarbon compounds, the process comprising:

a. hydrotreating the feedstock with a hydrotreating catalyst in the presence of hydrogen to produce a hydrotreated effluent containing a reduced amount of sulfur-containing hydrocarbon compounds;

b. separating the hydrotreated effluent in a high-pressure separation zone to produce a vapor stream and a hydrocarbon liquid stream;

c. purifying at least a portion of the vapor stream in an absorption zone in the presence of at least a portion of relatively heavier components of vapor stream from step (b) to produce a high purity hydrogen gas stream and a fuel gas stream;

d. saturating the aromatic compounds contained in a portion of the hydrocarbon liquid stream with an aromatic saturation catalyst in the presence of hydrogen gas to produce an aromatic saturated effluent, wherein the hydrogen gas includes the high purity hydrogen gas stream from step (c) along with make-up hydrogen stream;

e. separating the aromatic saturated effluent into an overhead gas stream, a condensed hydrocarbon liquid stream, and a sour water stream;

f. flashing the condensed hydrocarbon liquid stream to produce an overhead gas stream, a hydrocarbon liquid side stream and a sour water stream; and g. fractionating the hydrocarbon liquid side stream to produce a fractioned overhead stream and a fractioned bottom stream.

2. The process as in claim 1, where step (b) comprises separating the hydrotreated effluent in a hot high-pressure separation zone to produce a hydrotreated gas stream and a hydrotreated liquid stream, and separating the hydrotreated gas stream in a cold high-pressure separation zone to produce a vapor stream, a hydrocarbon liquid stream and a sour water stream, wherein the relatively heavier components of the vapor stream used in step (c) are derived from further condensation of the heavier fractions in the vapor stream generated from the cold separator and additional make up provided by the portion of the hydrocarbon liquid stream from the cold high-pressure separation zone.

3. The process as in claim 2, wherein step (d) comprises saturating the aromatic compounds contained in the hydrotreated liquid stream from the hot high-pressure separation zone.

* * * * *